US010393387B2

(12) United States Patent
Cadima

(10) Patent No.: US 10,393,387 B2
(45) **Date of Patent: *Aug. 27, 2019**

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 174 days.

This patent is subject to a terminal disclaimer.

(21) Appl. No.: 15/356,721

(22) Filed: Nov. 21, 2016

(65) Prior Publication Data

US 2018/0142901 A1 May 24, 2018

(51) Int. Cl.
*F24C 3/08* (2006.01)
*F23D 14/06* (2006.01)
*F23D 14/64* (2006.01)

(52) U.S. Cl.
CPC ..... *F24C 3/085* (2013.01); *F23D 14/06* (2013.01); *F23D 14/64* (2013.01); *F23D 2203/00* (2013.01); *F23D 2203/10* (2013.01)

(58) Field of Classification Search
CPC ..... F24C 3/085; F24C 15/10
See application file for complete search history.

(56) References Cited

U.S. PATENT DOCUMENTS

| | | | | |
|---|---|---|---|---|
| 7,967,004 | B2 * | 6/2011 | Inzaghi | F23D 14/045 126/214 C |
| 8,616,193 | B2 | 12/2013 | Padgett | |
| 9,127,838 | B2 | 9/2015 | Paesani et al. | |
| 9,970,662 | B2 * | 5/2018 | Cadima | F24C 15/107 |
| 9,995,482 | B2 * | 6/2018 | Cadima | F23D 14/84 |
| 2010/0005976 | A1 * | 1/2010 | Inzaghi | F23D 14/06 99/444 |
| 2010/0233643 | A1 * | 9/2010 | Biagioli | F23D 14/065 431/284 |
| 2011/0143295 | A1 * | 6/2011 | Fowler | F23D 14/06 431/285 |
| 2015/0107577 | A1 | 4/2015 | Jeong et al. | |
| 2015/0345799 | A1 | 12/2015 | Cadima et al. | |

* cited by examiner

*Primary Examiner* — Kenneth Rinehart
*Assistant Examiner* — Deepak A Deean
(74) *Attorney, Agent, or Firm* — Dority & Manning P.A.

(57) ABSTRACT

A gas burner assembly has a first fuel chamber within a burner body and this is contiguous with a plurality of inner flame ports. A second fuel chamber within the burner body is contiguous with a plurality of outer flame ports. A first supply duct extends between the first fuel chamber and a carryover duct. A second supply duct extends between the second fuel chamber and the carryover duct. A related cooktop appliance is also provided.

11 Claims, 5 Drawing Sheets

GAS BURNER ASSEMBLY FOR A COOKTOP APPLIANCE

FIELD OF THE INVENTION

The present subject matter relates generally to cooktop appliances and gas burner assemblies for cooktop appliances.

BACKGROUND OF THE INVENTION

Generally, gas cooktop appliances include a plurality of gas burners mounted to a top surface of the appliance. During use of the cooktop, spills and overflows can lead to food particles accumulating on the top surface of the cooktop. Such food particles can collect beneath the gas burners and be difficult to clean.

Gas cooking appliance users frequently cite difficulty cleaning beneath the gas burners as a complaint about modern cooktops. However, cleaning below gas burners on modern cooktops is difficult for a variety of reasons. For example, gas burners that are fastened to the cooktops generally include cracks at assembly interfaces that tend to accumulate food particles. As another example, gas burners that are removable from the cooktops by a user of the cooktop for cleaning generally include holes, supporting geometry and fasteners that are difficult to clean around. In addition, gas burners positioned coincident to top surfaces of associated cooktops inherently heat the top surfaces of the cooktops. The hot top surface of the cooktop can burn food particles, and burnt food particles on the cooktop can be particularly difficult to clean.

Accordingly, a cooktop appliance with features for facilitating cleaning below a burner of the cooktop appliance would be useful. In addition, a cooktop appliance with features for limiting heat transfer from a burner of the cooktop appliance to a top panel of the cooktop appliance would be useful.

In addition, certain cooktop appliances include multi-ring gas burners. Such burners can include a center burner surrounded by one or more concentric burner rings. Certain multi-ring gas burners ignite gaseous fuel, such as propane or natural gas, at one of the burner rings and utilize carryover ducts along the top surface of one of the burner rings to carry flames and ignite gaseous fuel at other burner rings.

Generally, carryover ducts suffer from certain problems. For example, fuel within the carryover duct can burn at an opening of the carryover duct rather than within the duct when a fuel and air mixture within the carryover duct is imbalanced. Thus, flames at one of the burner rings may not be transferred to other burner rings through the carryover duct if the fuel and air mixture within the carryover duct is imbalanced. However, forming a suitable fuel to air ratio within the carryover duct over a wide range of flow rates for the gas burner can be difficult. In addition, carryover ducts generally rely upon fuel collecting at a top of the carryover duct. At a top of the carryover duct, flame quenching is problematic, and copious amounts of fuel may be needed to overcome such quenching. However, large volumes of fuel may limit entrainment of air within the carryover duct such that an undesirably large flame is produced when the fuel within the carryover duct eventually ignites.

Accordingly, a multi-ring gas burner with features for reliably transferring flames between burners of the multi-ring gas burner at a variety of flow rates would also be useful.

BRIEF DESCRIPTION OF THE INVENTION

The present subject matter provides a gas burner assembly. A first fuel chamber within a burner body is contiguous with a plurality of inner flame ports. A second fuel chamber within the burner body is contiguous with a plurality of outer flame ports. A first supply duct extends between the first fuel chamber and a carryover duct. A second supply duct extends between the second fuel chamber and the carryover duct. A related cooktop appliance is also provided. Additional aspects and advantages of the invention will be set forth in part in the following description, or may be apparent from the description, or may be learned through practice of the invention.

In a first exemplary embodiment, a gas burner assembly is provided. The gas burner assembly includes a burner body having an inner side wall and an outer side wall. The inner side wall is spaced apart from the outer side wall along a radial direction. The burner body defines a plurality of inner flame ports and a plurality of outer flame ports. The plurality of inner flame ports is positioned at the inner side wall. The plurality of outer flame ports is positioned at the outer side wall. A first fuel chamber within the burner body is contiguous with the plurality of inner flame ports. A second fuel chamber within the burner body is contiguous with the plurality of outer flame ports. The first fuel chamber is separate from the second fuel chamber within the burner body. A carryover duct extends within the burner body between the inner and outer side walls. A first supply duct extends between the first fuel chamber and the carryover duct. A second supply duct extends between the second fuel chamber and the carryover duct.

In a second exemplary embodiment, a cooktop appliance is provided. The cooktop appliance includes a top panel. A gas burner assembly is positioned on the top panel. The gas burner assembly includes a burner body having an inner side wall and an outer side wall. The inner side wall is spaced apart from the outer side wall along a radial direction. The burner body defines a plurality of inner flame ports and a plurality of outer flame ports. The plurality of inner flame ports is positioned at the inner side wall. The plurality of outer flame ports is positioned at the outer side wall. A first fuel chamber within the burner body is contiguous with the plurality of inner flame ports. A second fuel chamber within the burner body is contiguous with the plurality of outer flame ports. The first fuel chamber is separate from the second fuel chamber within the burner body. A carryover duct extends within the burner body between the inner and outer side walls. A first supply duct extends between the first fuel chamber and the carryover duct. A second supply duct extends between the second fuel chamber and the carryover duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
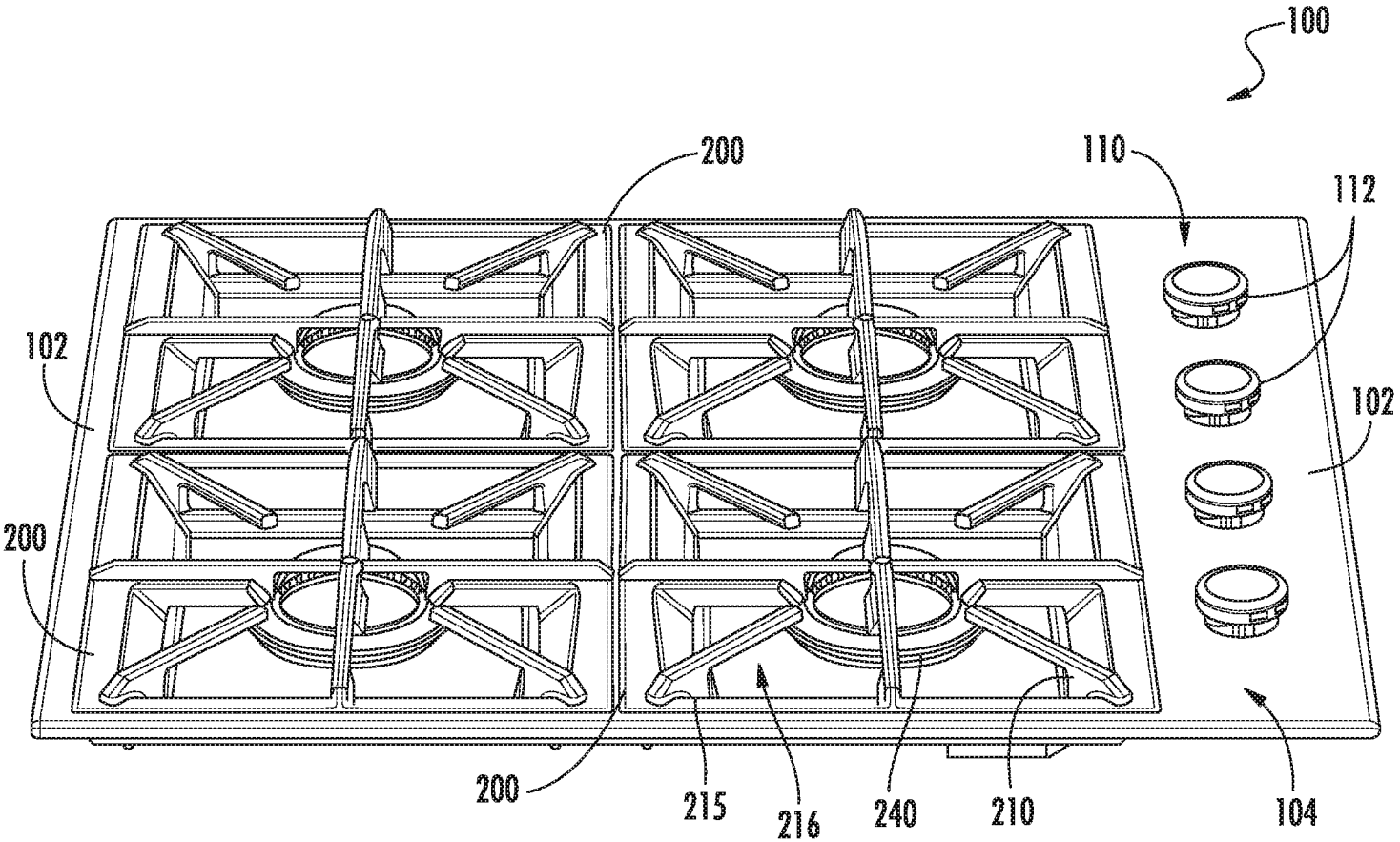
FIG. 1 provides a top, perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics, and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102 by combustion of fuel below the cooking utensils.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics, and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102 by combustion of fuel below the cooking utensils.

A user interface panel 110 is located within convenient reach of a user of cooktop appliance 100. For this exemplary embodiment, user interface panel 110 includes knobs 112 that are each associated with one of gas burner assemblies 200. Knobs 112 allow the user to activate each burner assembly and determine the amount of heat input each gas burner assembly 200 provides to a cooking utensil located thereon. User interface panel 110 may also be provided with one or more graphical display devices that deliver certain information to the user such as e.g., whether a particular burner assembly is activated and/or the level at which gas burner assembly 200 is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electromechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
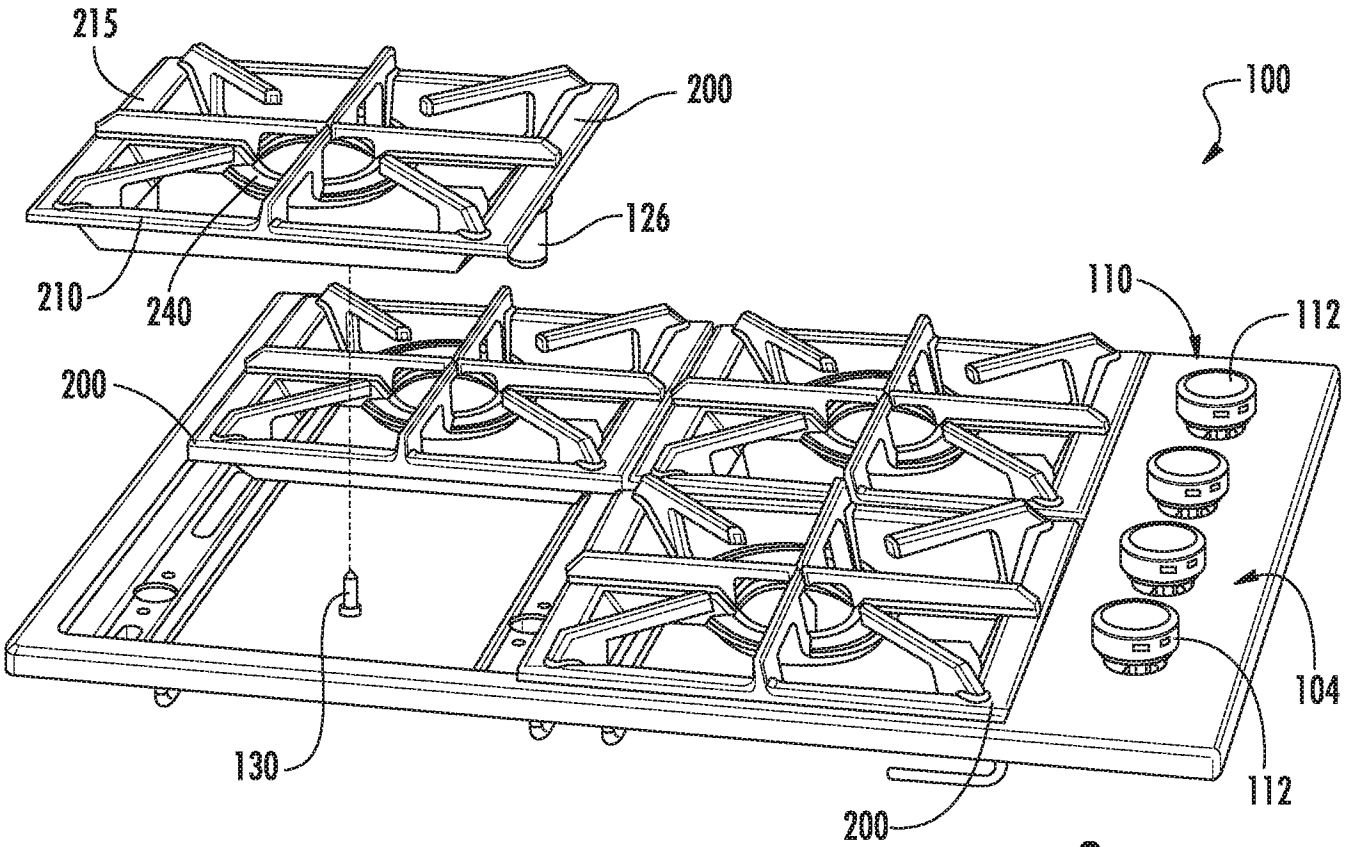
FIG. 2 provides another top, perspective view of the exemplary cooktop appliance of FIG. 1 with a gas burner assembly of the exemplary cooktop appliance shown removed from a panel of the exemplary cooktop appliance.

FIG. 2 provides another top, perspective view of cooktop appliance 100 with a gas burner assembly 200 of cooktop appliance 100 shown removed from panel 102 of cooktop appliance 100. As may be seen in FIG. 2, gas burner assembly 200 is removable from panel 102 of cooktop appliance 100. In certain exemplary embodiments, no mechanical fastening connects gas burner assembly 200 to panel 102. Thus, gas burner assembly 200 may not be fastened to panel 102, and a user may simply lift gas burner assembly 200 upwardly to remove gas burner assembly 200 from panel 102, as shown in FIG. 2. In such a manner, a top surface 104 of panel 102 below gas burner assembly 200 may be easily accessible and cleanable.

Figure 3:
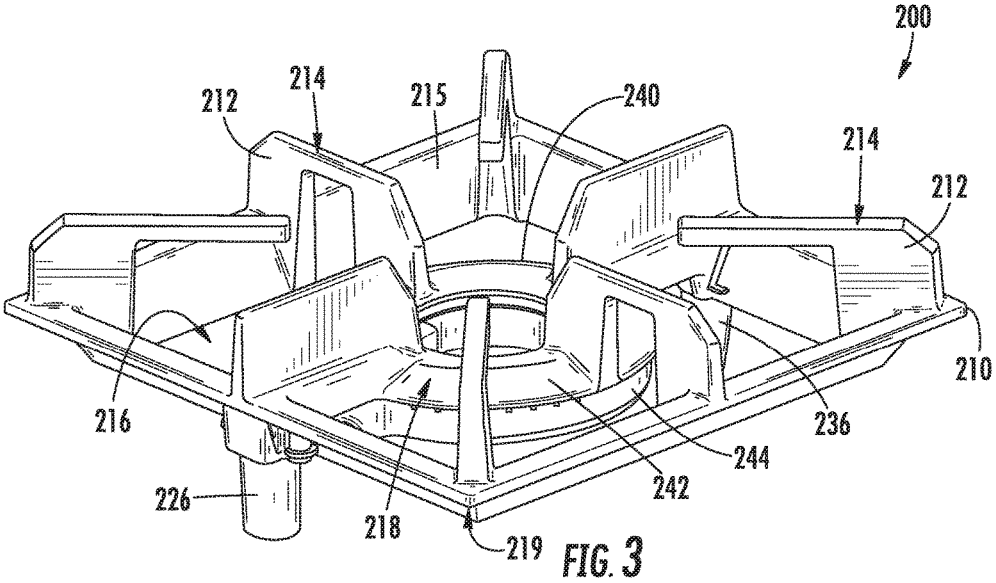
FIG. 3 provides a perspective view of a gas burner assembly according to an exemplary embodiment of the present subject matter.
Figure 4:
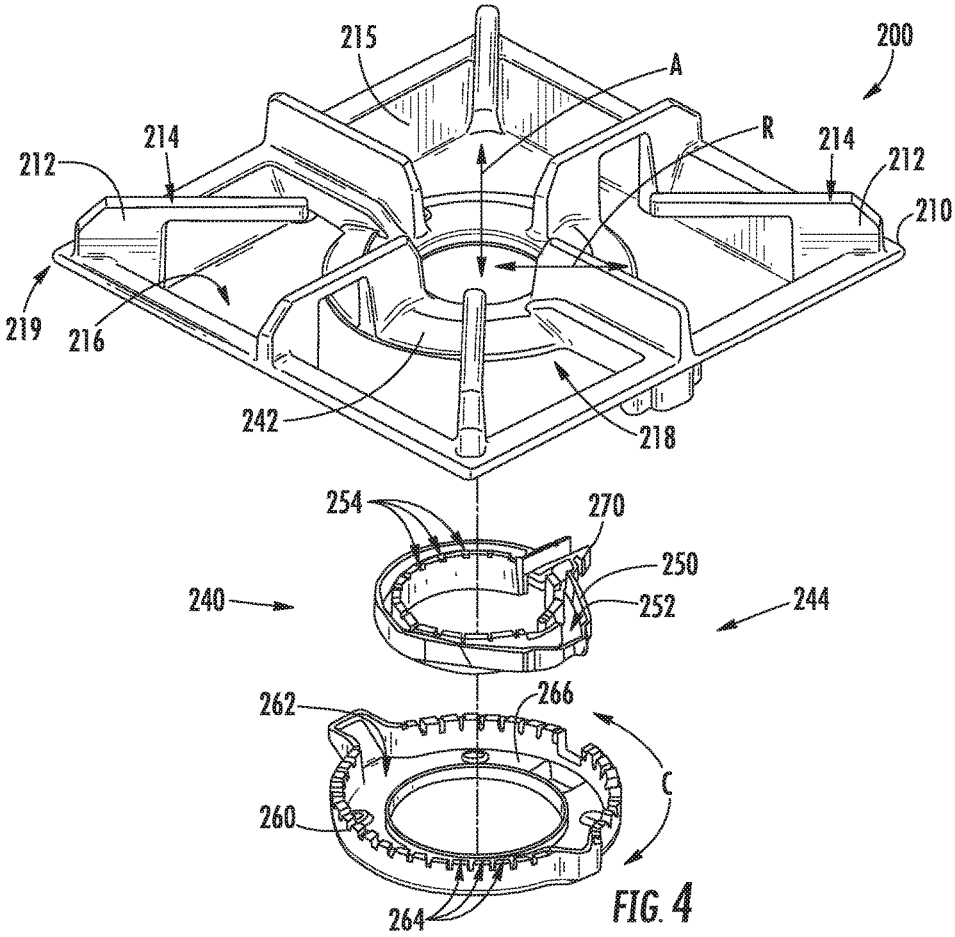
FIG. 4 provides a perspective, exploded view of the gas burner assembly of FIG. 3.
Figure 5:
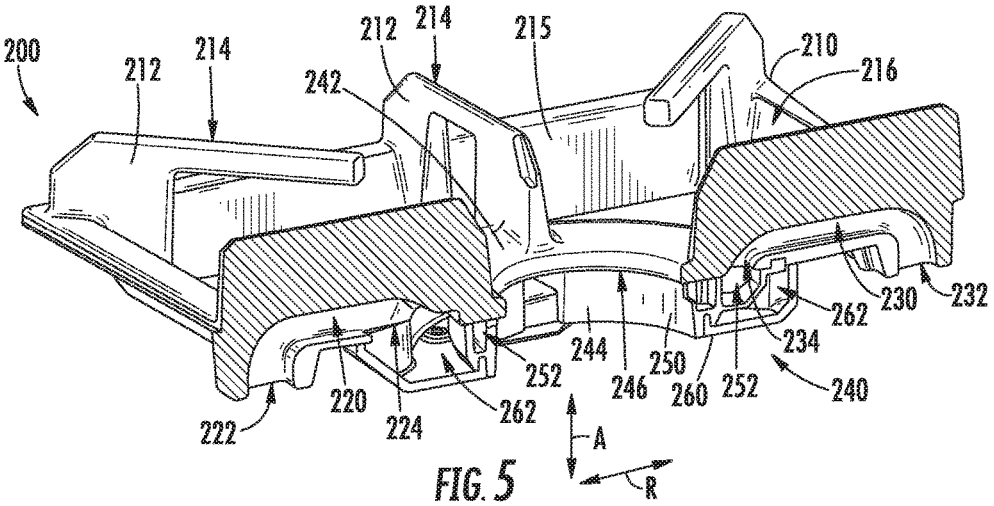
FIG. 5 provides a top perspective, section view of the gas burner assembly of FIG. 3.
Figure 6:
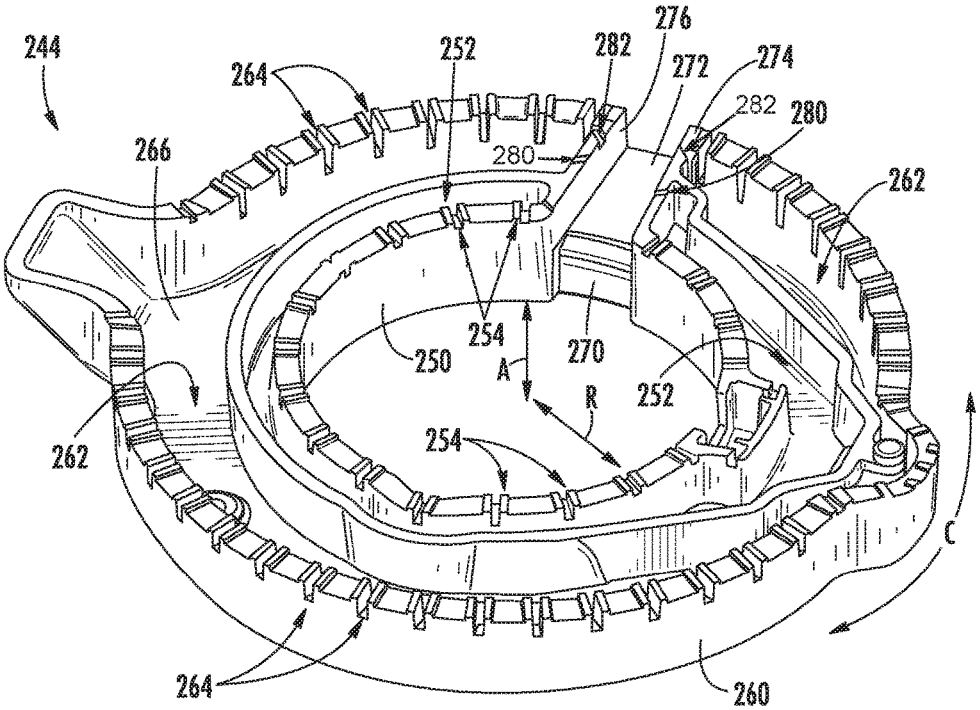
FIG. 6 provides a perspective view of a burner base of the gas burner assembly of FIG. 3.
Figure 7:
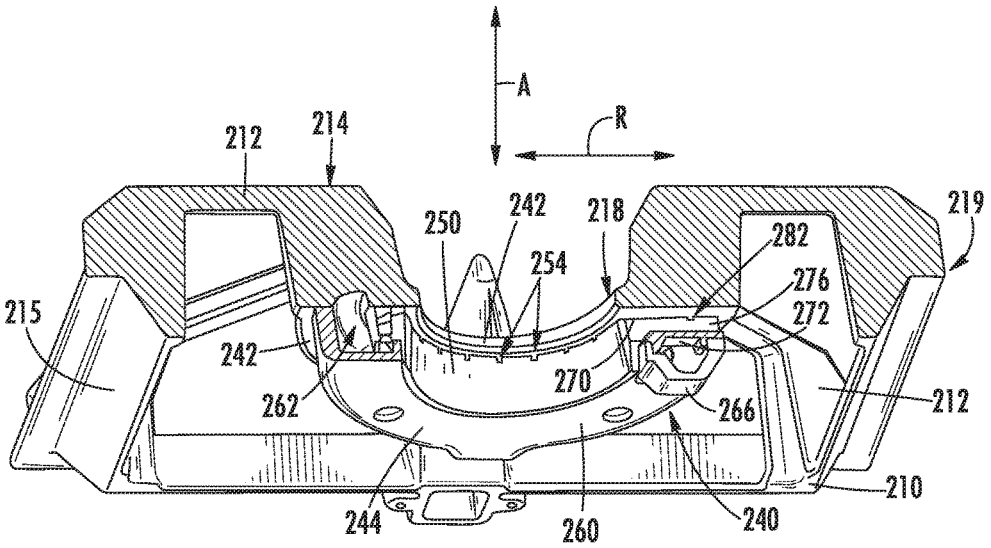
FIG. 7 provides a bottom perspective, section view of the gas burner assembly of FIG. 3.

FIG. 3 provides a perspective view of gas burner assembly 200. FIG. 4 provides a perspective, exploded view of gas burner assembly 200. FIG. 5 provides a top perspective, section view of gas burner assembly 200. FIG. 6 provides a perspective view of a burner base 240 of gas burner assembly 200. FIG. 7 provides a bottom perspective, section view of gas burner assembly 200. Various features of gas burner assembly 200 are discussed in greater detail below in the context of FIGS. 3 through 7.

As may be seen in FIGS. 3 through 7, gas burner assembly 200 includes a grate 210 and a burner body 240. Grate 210 is configured for supporting a cooking utensil, such as a pot, pan, etc. For example, grate 210 includes a plurality of elongated members 212, e.g., formed of cast metal, such as cast iron. The cooking utensil may be placed on the elongated members 212 of grate 210 such that the cooking utensil rests on an upper surface 214 of elongated members 212. Elongated members 212 of grate 210 may include an outer frame 215 that extends around or defines a perimeter of grate 210 and/or gas burner assembly 200. Thus, outer frame 215 may be positioned at an outer portion 219 of grate 210. Grate 210 may rest on panel 102 at outer frame 215 of grate 210. Thus, a bottom surface of outer frame 215 may rest on top surface 104 of panel 102. As shown in FIG. 4, outer frame 215 of grate 210 may be square or rectangular in certain exemplary embodiments. Within outer frame 215, elongated members 212 may define an inner passage 216 that extends vertically through grate 210. Thus, fluid, such as air, may flow through grate 210 via inner passage 216.

As may be seen in FIGS. 3 and 5, burner body 240 may be positioned at a central portion 218 of grate 210. Thus, burner body 240 may be positioned at or within inner passage 216 of grate 210, e.g., such that air within inner passage 216 of grate 210 flows by, around or through burner body 240. Burner body 240 may include a cap 242 and a base 244. Cap 242 of burner body 240 may be mounted to grate 210. In particular, cap 242 may be integrally formed with grate 210, e.g., such that grate 210 and cap 242 of burner body 240 are formed of or with a common piece of material. For example, grate 210 and cap 242 of burner body 240 may be cast as a single, continuous piece of metal, such as cast iron or aluminum. Base 244 of burner body 240 is mounted to cap 242 of burner body 240, e.g., with fasteners, such that base 244 and cap 242 of burner body 240 form flame ports of burner body 240, as discussed in greater detail below. Thus, cap 242 of burner body 240 and base 244 of burner body 240 may be separate pieces of material, such as cast or forged metal, that are mounted to each other to form burner body 240.

As shown in FIG. 6, burner body 240 may be a multi-ring burner, in certain exemplary embodiments. Thus, burner body 240 includes an inner burner ring 250 and an outer burner ring 260. The inner and outer burner rings 250, 260 may be concentrically positioned, e.g., such that outer burner ring 260 extends around inner burner ring 250. Inner burner ring 250 has a fuel chamber 252 and a plurality of flame ports 254. Flame ports 254 of inner burner ring 250 may be defined by a sidewall of inner burner ring 250, as shown in FIG. 6, such that flame ports 254 of inner burner ring 250 direct fuel inwardly along the radial direction R. Similarly, outer burner ring 260 has a fuel chamber 262 and a plurality of flame ports 264. Flame ports 264 of outer burner ring 260 may be defined by a sidewall of outer burner ring 260, as shown in FIG. 6, such that flame ports 264 of outer burner ring 260 direct fuel outwardly along the radial direction R. As may be seen from the above, flame ports 254 of inner burner ring 250 and flame ports 264 of outer burner ring 260 may be spaced apart from each other along the radial direction R. In addition, fuel chamber 252 of inner burner ring 250 may be separated from fuel chamber 262 of outer burner ring 260 within burner body 240, e.g., by a wall within burner body 240. As shown in FIG. 4, cap 242 of burner body 240 may define a passage 246 that allows air to flow through burner body 240 at inner burner ring 250. Fuel chamber 252 of inner burner ring 250 and/or fuel chamber 262 of outer burner ring 260 may extend circumferentially around passage 246 within base 244.

Turning now to FIG. 5, grate 210 includes features for supplying fuel to burner body 240, e.g., to inner burner ring 250 and outer burner ring 260 of burner body 240. In particular, grate 210 defines a first internal fuel passage 220 and a second internal fuel passage 230. First and second internal fuel passages 220, 230 are configured for directing fuel through grate 210 to burner body 240. In particular, first internal fuel passage 220 is contiguous with fuel chamber 252 of inner burner ring 250. Thus, fuel from first internal fuel passage 220 may flow into fuel chamber 252 of inner burner ring 250 and exit fuel chamber 252 of inner burner ring 250 at flame ports 254 of inner burner ring 250 where such fuel may be combusted. Similarly, second internal fuel passage 230 is contiguous with fuel chamber 262 of outer burner ring 260. Thus, fuel from second internal fuel passage 230 may flow into fuel chamber 262 of outer burner ring 260 and exit fuel chamber 262 of outer burner ring 260 at flame ports 264 of outer burner ring 260 where such fuel may be combusted.

By mounting burner body 240 to grate 210 and directing fuel through grate 210 to burner body 240, cleaning panel 102 below gas burner assembly 200 may be facilitated. For example, as shown in FIG. 1, burner body 240 may be mounted to grate 210 such that burner body 240 is suspended above or spaced apart from top surface 104 of panel 102, e.g., by a vertical gap. With burner body 240 separated from top surface 104 of panel 102, heat transfer between burner body 240 and panel 102 may be limited. Thus, panel 102 may be cooler during operation of gas burner assembly 200 relative to burners that contact panel 102, and burning of spilled or overflowed food particles on top surface 104 of panel 102 may be reduced or limited. In addition, with burner body 240 separated from top surface 104 of panel 102, access to panel 102 below burner body 240 may be easier than compared to burners that are positioned on and mounted to panel 102, and a user may more easily reach below burner body 240 to clean spills and overflows below burner body 240. Further, by supplying fuel through grate 210, burner body 240 need not receive fuel from directly below burner body 240 through panel 102. Thus, panel 102 may have no holes, less holes and/or smaller holes directly below burner body 240 relative to burners that are positioned on and mounted to panel 102 and receive fuel from directly below the burners. As shown in FIG. 2, an igniter 130 may be mounted to panel 102 below burner body 240, in certain exemplary embodiments.

As may be seen in FIG. 5, at least a portion of first and second internal fuel passages 220, 230 may be positioned above flame ports of burner body 240. In particular, at least a portion of first internal fuel passage 220 may be positioned above flame ports 254 of inner burner ring 250, and at least a portion of second internal fuel passage 230 may be positioned above flame ports 264 of outer burner ring 260. In such a manner, a vertical space occupied by gas burner assembly 200 may be reduced, and gas burner assembly 200 may have a compact vertical profile. In particular, utilizing first and second internal fuel passages 220, 230 to supply fuel to burner body 240 assists with reducing a vertical height of gas burner assembly 200 relative to burners that deliver fuel to burners from below the flame ports due to the required spacing between the burners and a cooking utensil needed for proper combustion of fuel. In such a manner, cooktop appliance 100 may have a sleek, low profile that is preferred by certain consumers by delivering fuel to burner body 240 through grate 210. As an example, a total vertical height of gas burner assembly 200 may be no greater than three inches in certain exemplary embodiments.

First internal fuel passage 220 extends between an inlet 222 and an outlet 224. Inlet 222 of first internal fuel passage 220 is positioned at or adjacent outer portion 219 of grate 210. Conversely, outlet 224 of first internal fuel passage 220 is positioned at or adjacent central portion 218 of grate 210. Thus, first internal fuel passage 220 may extend between outer portion 219 and central portion 218 of grate 210 within one of the elongated members 212 of grate 210. First Venturi mixer 226 is positioned at inlet 222 of first internal fuel passage 220. First Venturi mixer 226 may also be positioned above a fuel orifice below panel 102. Thus, fuel from the fuel orifice may pass through first Venturi mixer 226 and enter first internal fuel passage 220 at inlet 222 of first internal fuel passage 220. Outlet 224 of first internal fuel passage 220 is contiguous with fuel chamber 252 of inner burner ring 250. Thus, fuel from first internal fuel passage 220 may flow into burner body 240 via outlet 224 of first internal fuel passage 220.

Second internal fuel passage 230 also extends between an inlet 232 and an outlet 234. Inlet 232 of second internal fuel passage 230 is positioned at or adjacent outer portion 219 of grate 210. Conversely, outlet 234 of second internal fuel passage 230 is positioned at or adjacent central portion 218 of grate 210. Thus, second internal fuel passage 230 may extend between outer portion 219 and central portion 218 of grate 210 within one of the elongated members 212 of grate 210. Second Venturi mixer 236 is positioned at inlet 232 of second internal fuel passage 230. Second Venturi mixer 236 may also be positioned above a fuel orifice below panel 102. Thus, fuel from the fuel orifice may pass through second Venturi mixer 236 and enter second internal fuel passage 230 at inlet 232 of second internal fuel passage 230. Outlet 234 of second internal fuel passage 230 is contiguous with fuel chamber 262 of outer burner ring 260. Thus, fuel from second internal fuel passage 230 may flow into burner body 240 via outlet 234 of second internal fuel passage 230.

As shown in FIG. 3, first and second Venturi mixers 226, 236 may be positioned opposite each other on gas burner assembly 200. In particular, burner body 240 may be positioned between first and second Venturi mixers 226, 236. Thus, first and second internal fuel passages 220, 230 may also be positioned opposite each other on gas burner assembly 200, and burner body 240 may be positioned between first and second internal fuel passages 220, 230. In particular, outlet 224 of first internal fuel passage 220 may be positioned opposite outlet 234 of second internal fuel passage 230 on burner body 240.

Grate 210 may be constructed of or with any suitable material. For example, grate 210 may be constructed of or with a single piece of cast metal. In particular, grate 210 may be formed of cast iron with first and second internal fuel passages 220, 230 formed within grate 210 using disposable cores during the casting process. First and second Venturi mixers 226, 236 may also be integrally formed with grate 210 or may be separate components mounted, e.g., fastened, to grate 210.

Turning now to FIGS. 5 through 7, burner body 240 also includes a crossover duct 270. Crossover duct 270 extends between inner burner ring 250 and outer burner ring 260. Crossover duct 270 is configured for assisting with transferring flames between inner burner ring 250 and outer burner ring 260. Thus, e.g., fuel at flame ports 254 of inner burner ring 250 may be ignited with igniter 130, and flames at flame ports 254 of inner burner ring 250 may ignite fuel within crossover duct 270 that in turn ignites fuel at flame ports 264 of outer burner ring 260. Crossover duct 270 may also include or define ports, e.g., at a top portion of crossover duct 270 at cap 242.

As shown in FIG. 6, burner body 240 includes a first supply duct 280 and a second supply duct 282. First supply duct 280 extends, e.g., along the circumferential direction C, between fuel chamber 252 of inner burner ring 250 and crossover duct 270. Thus, fuel from fuel chamber 252 of inner burner ring 250 may flow through first supply duct 280 to crossover duct 270. Second supply duct 282 extends, e.g., along the circumferential direction C, between fuel chamber 262 of outer burner ring 260 and crossover duct 270. Thus, fuel from fuel chamber 262 of outer burner ring 260 may flow through second supply duct 282 to crossover duct 270.

It will be understood that while shown with one first supply duct 280 and one second supply duct 282 in the exemplary embodiment shown in FIG. 6, burner body 240 may include multiple first supply ducts 280 and/or multiple second supply ducts 282 in alternative exemplary embodiments. Thus, multiple first supply ducts 280 may extend between fuel chamber 252 of inner burner ring 250 and crossover duct 270, and multiple second supply ducts 282 may extend between fuel chamber 262 of outer burner ring 260 and crossover duct 270. The multiple first supply ducts 280 and multiple second supply ducts 282 may have a common total cross-section area, e.g., along the circumferential direction C.

First and second supply ducts 280, 282 may supply fuel to crossover duct 270 independently of each other. For example, during operation of gas burner assembly 200 in multi-ring mode, fuel from fuel chamber 252 of inner burner ring 250 may flow through first supply duct 280 to crossover duct 270 at a constant rate regardless of a heat output for gas burner assembly 200 selected by a user of gas burner assembly. Conversely, fuel from fuel chamber 262 of outer burner ring 260 may flow through second supply duct 282 to crossover duct 270 may vary depending upon the heat output for gas burner assembly 200 selected by the user of gas burner assembly 200 during operation of gas burner assembly 200 in multi-ring mode. Thus, fuel flow into crossover duct 270 from first and second supply ducts 280, 282 has two degrees of freedom and may be more specifically tuned to an operating condition of gas burner assembly 200 relative to gas burners with a crossover duct fed from a single, common chamber. Such tuning can provide a constant fuel supply from crossover duct 270 at inner burner ring 250 and can also adjust (e.g., increase or decrease) a fuel supply from crossover duct 270 at outer burner ring 260. In such a manner, robust flame transfer between flame rings can be achieved over a wide operating range.

First and second supply ducts 280, 282 may be spaced apart from each other along the circumferential direction C within crossover duct 270. For example, first supply duct 280 may be positioned opposite second supply duct 282 along the circumferential direction C about crossover duct 270. In particular, as shown in FIG. 6, crossover duct 270 has a first sidewall 274 and a second sidewall 276 that are spaced apart from each other, e.g., along the circumferential direction C. First and second sidewalls 274, 276 may correspond to radial boundaries of crossover duct 270. First supply duct 280 may be positioned or formed on first sidewall 274. Thus, first supply duct 280 may extend, e.g., along the circumferential direction C, on first sidewall 274 between fuel chamber 252 of inner burner ring 250 and crossover duct 270. Second supply duct 282 may be positioned or formed on second sidewall 276. Thus, second supply duct 282 may extend, e.g., along the circumferential direction C, on second sidewall 276 between fuel chamber 262 of outer burner ring 260 and crossover duct 270.

First and second supply ducts 280, 282 may also be spaced apart from each other along the radial direction R within crossover duct 270. For example, as shown in FIG. 6, second supply duct 282 may also be positioned closer to outer burner ring 260 (e.g., flame ports 264 of outer burner ring 260) than first supply duct 280 along the radial direction R. Similarly, first supply duct 280 may also be positioned closer to inner burner ring 250 (e.g., flame ports 254 of inner burner ring 250) than second supply duct 282 along the radial direction R.

First and second supply ducts 280, 282 may be oriented to facilitate operation of crossover duct 270. For example, first and second supply ducts 280, 282 may be oriented in opposite directions, e.g., along the radial direction R. In particular, first supply duct 280 may be oriented inwardly along the radial direction R, as shown in FIG. 6. Thus, fuel from fuel chamber 252 of inner burner ring 250 entering crossover duct 270 at first supply duct 280 may have a radial velocity component that is directed towards a center of burner body 240. Conversely, second supply duct 282 may be oriented outwardly along the radial direction R. Thus, fuel from fuel chamber 262 of outer burner ring 260 entering crossover duct 270 at second supply duct 282 may have a radial velocity component that is directed away from the center of burner body 240. In alternative exemplary embodiments, first supply duct 280 may be oriented outwardly along the radial direction R, and second supply duct 282 may be oriented inwardly along the radial direction R. In other exemplary embodiments, first and second supply ducts 280, 282 may both be oriented inwardly or outwardly along the radial direction R.

Crossover duct 270 may be positioned such that fuel within fuel chamber 262 of outer burner ring 260 may flow beneath crossover duct 270. Thus, as shown in FIG. 7, a bottom wall 272 of crossover duct 270 may be spaced apart from or suspended over bottom wall 266 of outer burner ring 260, e.g., by no less than a quarter of an inch. By separating bottom wall 272 of crossover duct 270 from bottom wall 266 of outer burner ring 260, fuel within fuel chamber 262 of outer burner ring 260 may flow between bottom wall 272 of crossover duct 270 and bottom wall 266 of outer burner ring 260. In such a manner, fuel distribution to flame ports 264 of outer burner ring 260 within fuel chamber 262 of outer burner ring 260 may be improved or facilitated relative to burners where a crossover duct extends across and divides fuel chamber 262 of outer burner ring 260. As shown in FIGS. 5 through 7, bottom wall 272 (e.g., and sidewalls 274, 276) of crossover duct 270 may be integrally formed with inner burner ring 250. Thus, bottom wall 272 of crossover duct 270 and inner burner ring 250 may be formed of or with a common piece of material, such as cast metal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly, comprising:

a burner body having an inner side wall and an outer side wall, the inner side wall spaced apart from the outer side wall along a radial direction, the burner body defining a plurality of inner flame ports and a plurality of outer flame ports, the plurality of inner flame ports positioned at the inner side wall, the plurality of outer flame ports positioned at the outer side wall, a first fuel chamber within the burner body contiguous with the plurality of inner flame ports, a second fuel chamber within the burner body contiguous with the plurality of outer flame ports, the first fuel chamber separate from the second fuel chamber within the burner body, wherein a carryover duct extends within the burner body between the inner and outer side walls, a first supply duct extends between the first fuel chamber and the carryover duct, a second supply duct extends between the second fuel chamber and the carryover duct, and wherein the second fuel chamber extends beneath the carryover duct such that fuel within the second fuel chamber is flowable beneath the crossover duct.

2. The gas burner assembly of claim 1, wherein the first supply duct is oriented inwardly along the radial direction.

3. The gas burner assembly of claim 1, wherein the second supply duct is oriented outwardly along the radial direction.

4. The gas burner assembly of claim 3, wherein the first supply duct is oriented inwardly along the radial direction.

5. The gas burner assembly of claim 4, wherein the second supply duct is positioned closer to the outer side wall than the first supply duct.

6. The gas burner assembly of claim 1, wherein the burner body has a first carryover duct wall and a second carryover duct wall, the carryover duct defined between the first and second carryover duct walls, the first and second carryover duct walls spaced along a circumferential direction, the first supply duct positioned on the first carryover duct wall, the second supply duct positioned on the second carryover duct wall.

7. The gas burner assembly of claim 1, wherein the burner body has a first burner body portion and a second burner body portion formed discrete each other, the second burner body portion nested within the first burner body portion, the first burner body portion forming the outer side wall, the second burner body portion forming the inner side wall and the carryover duct.

8. The gas burner assembly of claim 1, wherein the first supply duct is oriented outwardly along the radial direction and the second supply duct is oriented inwardly along the radial direction.

9. The gas burner assembly of claim 1, further comprising a grate, the grate defining a first fuel supply passage and a second fuel supply passage, the burner body mounted to the grate such that the first fuel supply passage is contiguous with the first fuel chamber and such that the second fuel supply passage is contiguous with the second fuel chamber.

10. The gas burner assembly of claim 9, further comprising a cap integrally formed with the grate, the burner body mounted to the cap.

11. The gas burner assembly of claim 1, wherein at least additional first supply duct extends between the first fuel chamber and the carryover duct and at least one additional second supply duct extends between the second fuel chamber and the carryover duct.

* * * * *